US006788324B2

(12) United States Patent
Fisher et al.

(10) Patent No.: US 6,788,324 B2
(45) Date of Patent: Sep. 7, 2004

(54) ENCODER-BASED CONTROL OF PRINTHEAD FIRING IN A LABEL PRINTER

(75) Inventors: Richard P. Fisher, Eden Prairie, MN (US); David T. Gale, Champlin, MN (US); Douglas R. Kremers, Champlin, MN (US); Daniel K. Workman, Zimmerman, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 161 days.

(21) Appl. No.: 10/068,235

(22) Filed: Feb. 6, 2002

(65) Prior Publication Data

US 2003/0146966 A1 Aug. 7, 2003

(51) Int. Cl.[7] ..... B41J 2/36
(52) U.S. Cl. ..... 347/188
(58) Field of Search ..... 347/188, 54, 57, 347/14, 218; 400/279, 280, 582, 583

(56) References Cited

U.S. PATENT DOCUMENTS

| | | | | |
|---|---|---|---|---|
| 5,078,523 A | | 1/1992 | McGourty et al. | 400/613 |
| 5,138,341 A | | 8/1992 | Kobayashi | 346/136 |
| 5,157,761 A | | 10/1992 | Hawkes | 395/107 |
| 5,163,675 A | | 11/1992 | Sunohara | 271/274 |
| 5,188,009 A | | 2/1993 | Sunohara et al. | 83/13 |
| 5,202,958 A | | 4/1993 | Kobayashi | 395/102 |
| 5,275,077 A | | 1/1994 | Kobayashi | 83/880 |
| 5,318,370 A | | 6/1994 | Nehowig | 400/613 |
| 5,322,380 A | * | 6/1994 | Crocker | 400/124.04 |

(List continued on next page.)

FOREIGN PATENT DOCUMENTS

| | | | |
|---|---|---|---|
| EP | 0 727 315 A2 | 8/1996 | B41J/3/00 |
| EP | 0 887 195 A1 | 12/1998 | B41J/13/02 |

OTHER PUBLICATIONS

U.S. patent application Ser. No. 09/683,717, filed Feb. 6, 2002, pending.
U.S. patent application Ser. No. 09/683,718, filed Feb. 6, 2002, pending.
Brochure—Brady® Make–It–Yourself Products, It's Important to use the Right Tool for the Right Job, Brady Worldwide, Inc., 1999.
Brochure—Brady® Graphic Solutions, GraphicsPro™ Label & Sign Creator Offers the Convenience of Custom Labels and Signs at the Touch of a Fingertip, W.H. Brady Co./Brady USA, Inc., 1997.
Brochure—Impressa 2 digital label & decal press, Print and Cut Your Own Full–Color Labels and Decals in any Size or Shape!, pp. 1–6, Primera Technology, Inc., 1998.
Brochure—ColorCAMM PRO Versatility, Roland DGA Corporation, 2000.
Brochure—The Future of Sign Making is here, Gerber Edge, Gerber Scientific Products, Inc., 1994.

*Primary Examiner*—K. Feggins
(74) *Attorney, Agent, or Firm*—Whyte Hirschboeck Dudek SC

(57) ABSTRACT

A method of determining the position of a label media and printing to the label media based on the label media position is disclosed. The method includes using an encoder to track the position of the label media. As the label media advances during printing, an encoder shaft rotates with an encoder traction roller upon which the label media rides. As the encoder shaft rotates, optical reflections that occur within the encoder are interrupted, each interruption corresponding to a desired media travel distance. When the optical reflection is interrupted, the encoder sends a signal to the controller, which then sends a control signal to fire the printhead, and consequently the label media is thermally printed. The system is useful in thermal printer systems to provide more accurate position information of the label media, and consequently, more accurate printing. In this manner, with the encoder tracking the motion of the media, the timing of the printing of the label media is determined upon the actual position of the label media itself.

4 Claims, 12 Drawing Sheets

U.S. PATENT DOCUMENTS

| | | | | | |
|---|---|---|---|---|---|
| 5,508,088 | A | | 4/1996 | Braun | 428/195 |
| 5,511,891 | A | | 4/1996 | Nehowig et al. | 400/583 |
| 5,755,519 | A | | 5/1998 | Klinefelter | 400/249 |
| 5,819,649 | A | | 10/1998 | Townsend et al. | 101/93.01 |
| 5,823,689 | A | | 10/1998 | Nehowig et al. | 400/83 |
| 5,823,692 | A | | 10/1998 | Tolrud et al. | 400/582 |
| 5,887,993 | A | | 3/1999 | Nunokawa et al. | 400/208 |
| 6,007,263 | A | | 12/1999 | Imai et al. | 400/693 |
| 6,008,831 | A | | 12/1999 | Nakanishi et al. | 347/195 |
| 6,015,241 | A | * | 1/2000 | Wiklof et al. | 400/578 |
| 6,020,907 | A | | 2/2000 | Fassler et al. | 347/218 |
| 6,034,705 | A | | 3/2000 | Tolle et al. | 347/195 |
| 6,042,279 | A | | 3/2000 | Ackley | 400/103 |
| 6,046,756 | A | | 4/2000 | Iga et al. | 347/173 |
| 6,099,178 | A | | 8/2000 | Spurr et al. | 400/207 |
| 6,112,658 | A | | 9/2000 | Gunther et al. | 101/171 |
| 6,149,325 | A | | 11/2000 | Nunokawa et al. | 400/208 |
| 6,186,333 | B1 | | 2/2001 | Hautala et al. | 209/17 |
| 6,201,256 | B1 | | 3/2001 | Kouchi et al. | 250/559.44 |
| 6,213,659 | B1 | | 4/2001 | Elgee | 400/633 |
| 6,246,050 | B1 | | 6/2001 | Tullis et al. | 250/231.13 |
| 6,249,302 | B1 | | 6/2001 | Sekiya | 347/220 |
| 6,264,296 | B1 | | 7/2001 | Klinefelter et al. | 347/4 |
| 6,264,774 | B1 | | 7/2001 | Lenz et al. | 156/64 |
| 6,266,075 | B1 | | 7/2001 | Feitel et al. | 347/198 |
| D446,544 | S | | 8/2001 | Platner et al. | D18/50 |
| 6,270,858 | B1 | | 8/2001 | Paulson | 427/508 |
| 6,276,849 | B1 | | 8/2001 | Feitel et al. | 400/242 |
| 6,422,941 | B1 | * | 7/2002 | Thorner et al. | 463/30 |
| 6,631,495 | B2 | * | 10/2003 | Kato et al. | 715/500 |
| 6,636,161 | B2 | * | 10/2003 | Rosenberg | 341/20 |
| 6,639,581 | B1 | * | 10/2003 | Moore et al. | 345/156 |
| 2001/0013765 | A1 | | 8/2001 | Yamamoto et al. | 318/600 |

* cited by examiner

FIG. 7
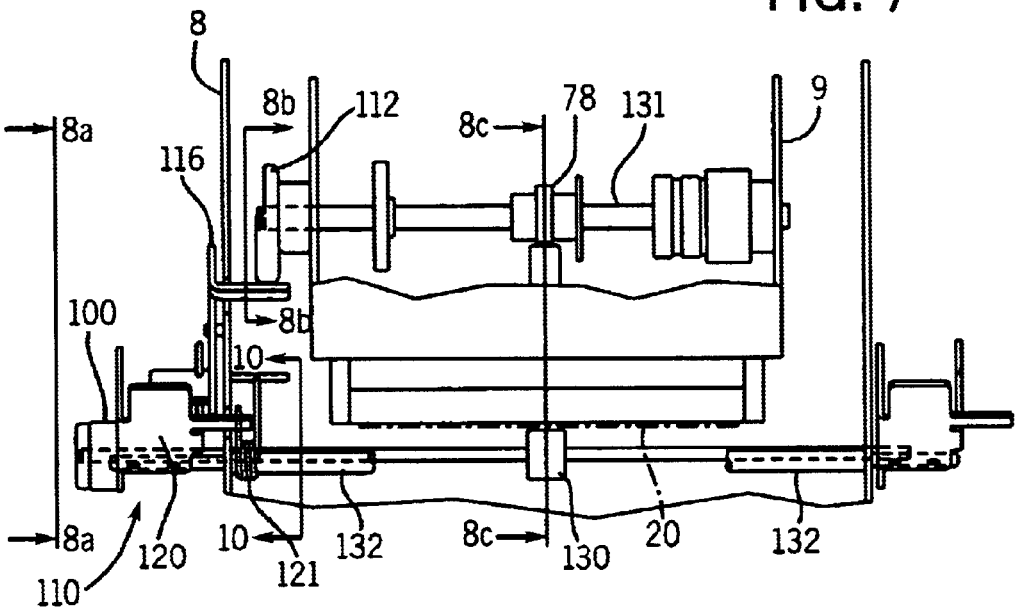
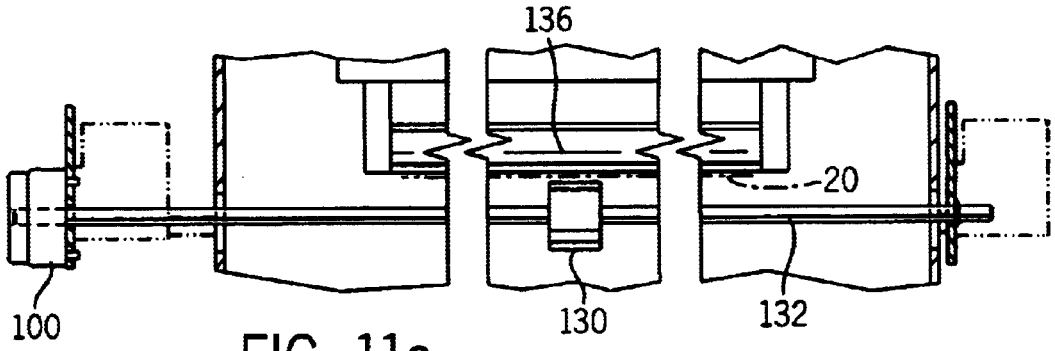
FIG. 11a
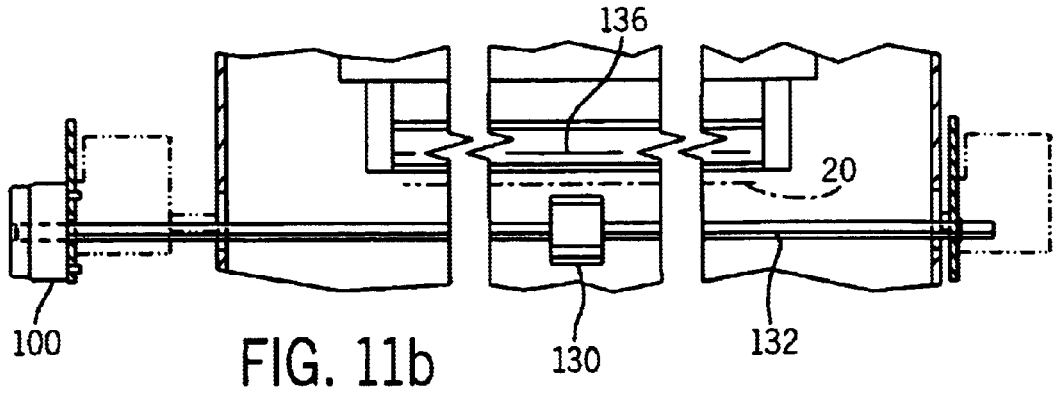
FIG. 11b

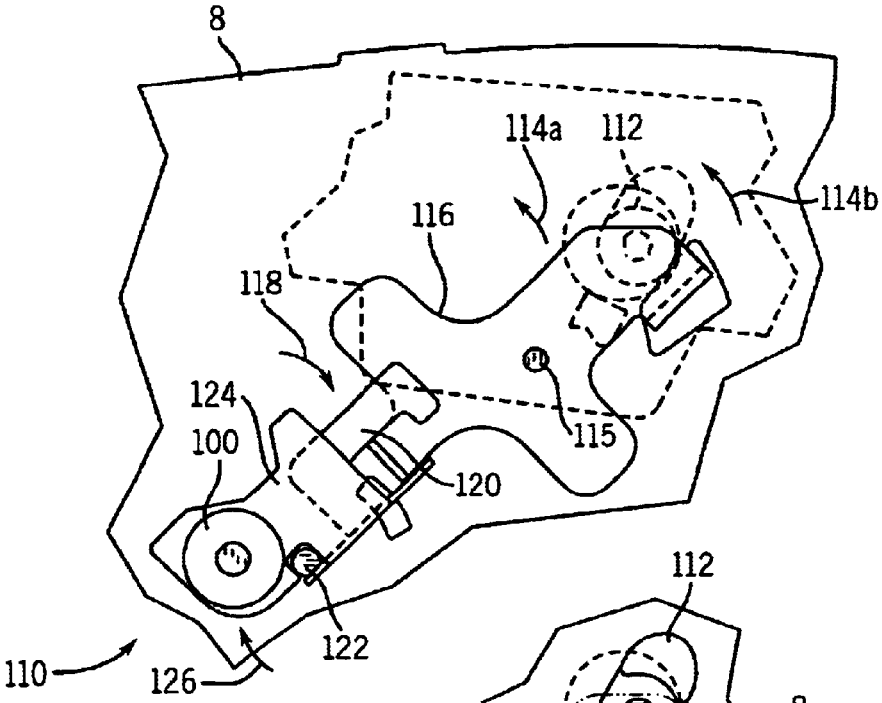
FIG. 8a
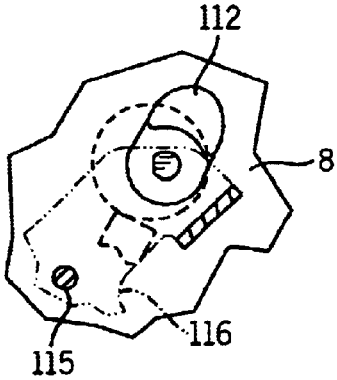
FIG. 8b
FIG. 8c
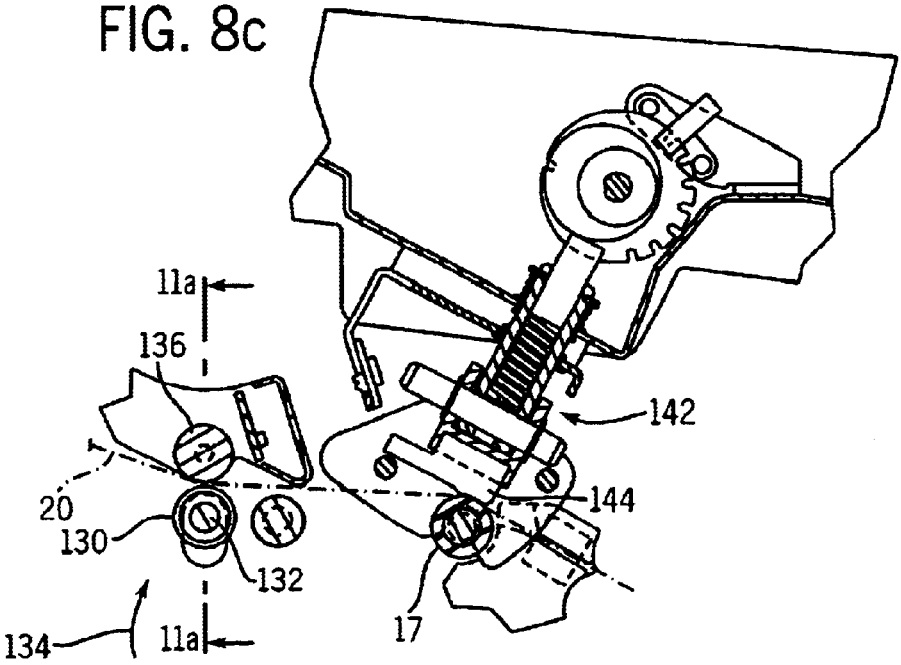

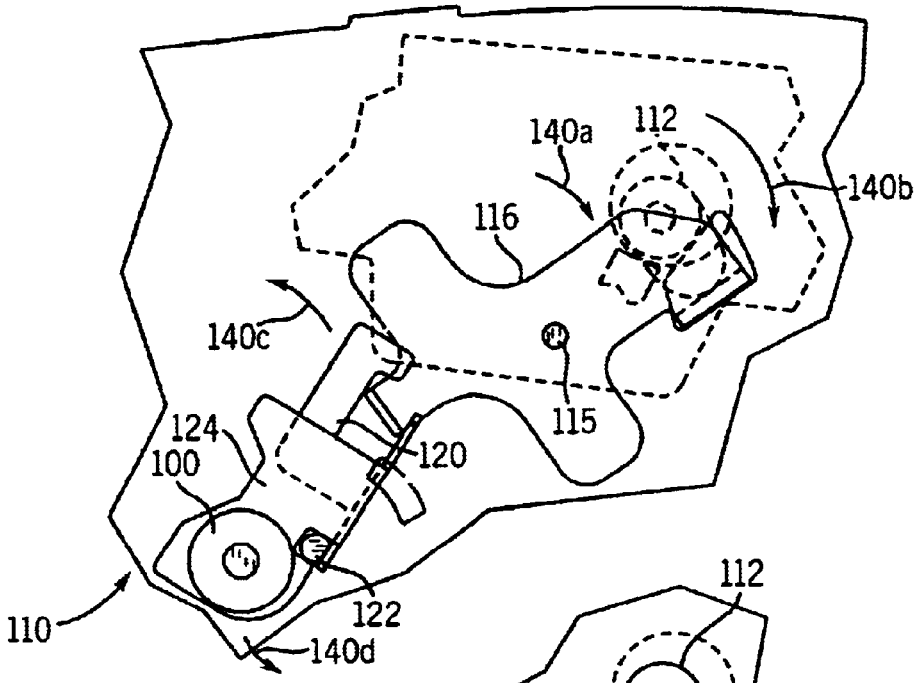
FIG. 9a
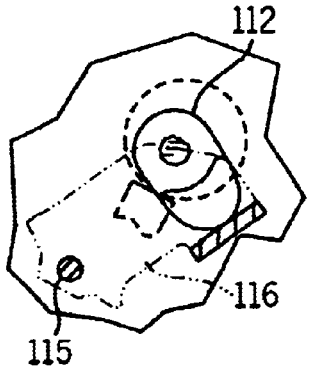
FIG. 9b
FIG. 9c
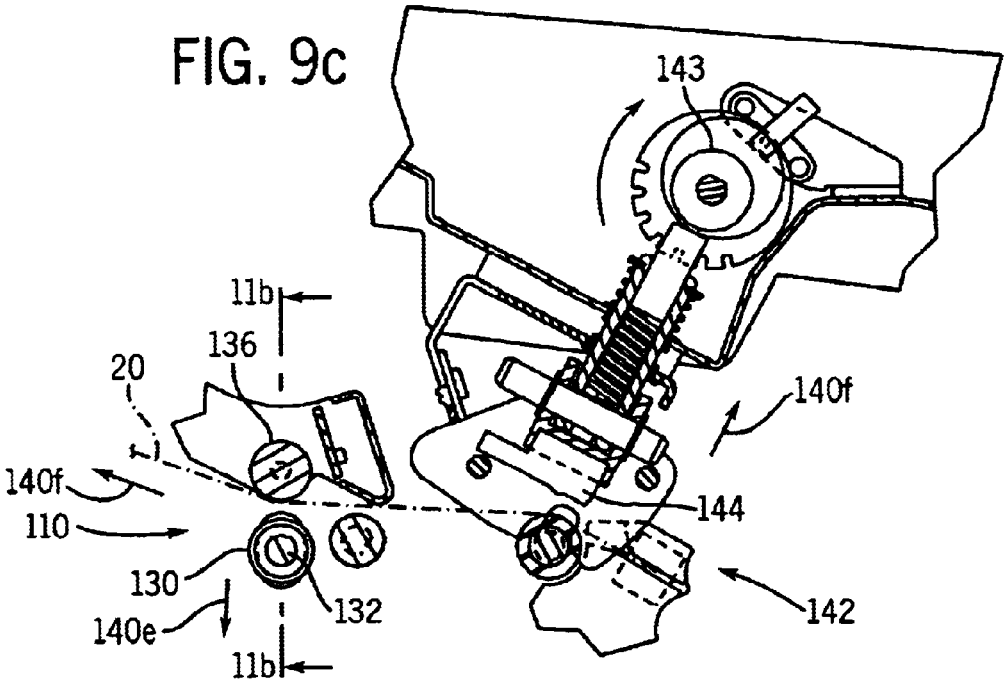

FIG. 12a
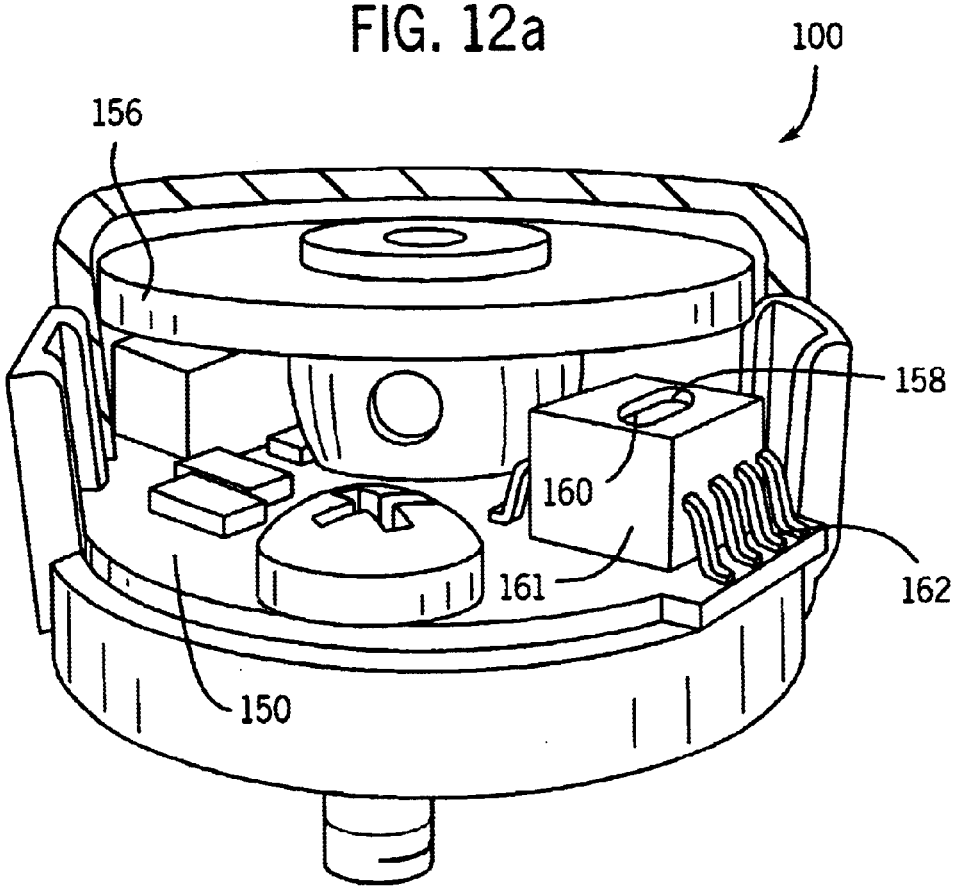
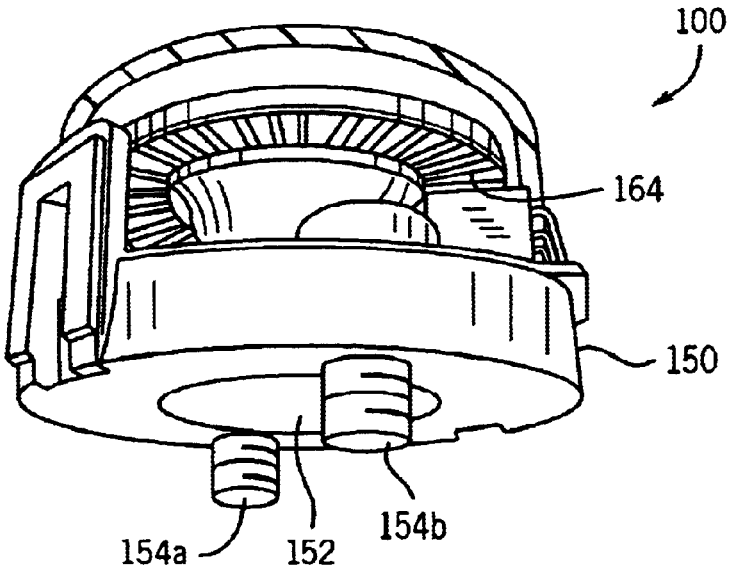
FIG. 12b

ENCODER-BASED CONTROL OF PRINTHEAD FIRING IN A LABEL PRINTER

BACKGROUND OF THE INVENTION

This invention relates generally to media printing systems. More particularly, the invention relates to a media printing system having an encoder that monitors the actual position of the media in order to control the firing of the printhead for the printing system.

Electronic label printing machines are often used to generate adhesive labels having images (e.g., indicia, graphics, art, specialized instructions, warnings, slogans, advertising, etc.) to facilitate identification, tracking and pricing of goods. Such label printers typically include: a printhead, an assembly (e.g., a label media cartridge) for supplying and feeding a label media past the printhead in order to be printed, a microprocessor, a read-only memory (ROM) programmed with appropriate instructions therein to operate the microprocessor, a random access memory (RAM), a keyboard with letter, number, and function keys for entry of alphanumeric information requisite to printing the indicia on the label media, and a visual display such as a Light Emitting Diode (LED) or Liquid Crystal Display (LCD) screen to convey information to a machine operator. These components function together to achieve the end goal of creating high quality and accurate labels from the label media using the electronic label printing machine.

Labels are made from a label media. The label media itself typically is made up of a roll of pressure sensitive tape that is attached, typically along a side containing an adhesive, to a continuous support roll of release liner material. The label media is fed in a media direction along a media path through the label printer. Discrete labels are formed by cutting the label media. Complex label shapes can be obtained by plotter cutting the tape layer only of the label media. The label media can be end cut (i.e., cutting through the tape and the release liner layers) or portioned into an end cut label media portion in order to obtain as many discrete labels in a continuous row as is desired. In other words, one or more than one discrete label can reside on an end cut label media portion. An end cutting operation can occur with or without a plotter cutting operation first having taken place. Following label media cutting, the discrete labels can be removed from the release liner and attached, as appropriate, to the particular application requiring identification. Since there are many types of label applications, there are many combinations of tape and release liners that can provide labels of varying sizes, colors, formats, and characteristics.

One type of label printer employs a thermal transfer printhead. In general, the use of thermal printheads in label printers has increased as the quality and accuracy of thermal printheads has improved. Thermal transfer printing uses a heat-generating printhead to transfer an ink, or the like, from a thermal transfer ribbon to a label media to form a label image on the media. A microprocessor determines a sequence of individual thermal, typically resistive, printhead elements to be selectively heated or energized. Energizing the sequence of elements in turn heats the ribbon so as to transfer the ink from the ribbon, creating the desired image on the label media, and specifically, on the label tape. The label printer can be fed label media from a label media cartridge. Simultaneously, a thermal transfer ribbon can be fed from a ribbon cartridge. While the label media runs between the printhead and a support (platen) roller, the transfer ribbon can run between the printhead and the support roller. Thus, the label media and the transfer ribbon can run together in an overlay relationship between the printhead and the support roller.

When it is desired to print a color image on a label media, it is generally required to print the image by passing the label media several times past the printhead. To accomplish each pass, the label media is fed, retracted, and then re-fed again past the thermal printhead. With each pass, a different primary color, for example, in a traditional color scheme, cyan, magenta, yellow, and black, is printed from a continuous ink ribbon onto the label media using the printhead. In this manner, based on the amount of each color printed, a composite color image can be printed onto a label media.

It is desirable to be able to track the position of the media. In prior systems, the position of the media is dependent upon the step resolution of the motor that controls the position of the media. By monitoring the motor, consequently, the position of the media moved by the motor can be identified. However, because of problems such as media slip within the transport mechanism, the media may become offset from the motor controlling the movement of the media. The result is a print defect in the output of the printing system, particularly when there is no feedback to a control microprocessor that slip has occurred.

Even in those systems in which positioning of the media is determined by monitoring the media, generally any information obtained is used to control the speed of a drive motor that is connected to the platen on which the media is travelling. The position of the media does not correspond to any printing operation.

Therefore, it would be desirable to be able to track the print media directly and send signals based upon the positioning of the media and generate a signal that results in firing a thermal printhead, therefore bypassing any irregularities in the media positioning system.

SUMMARY OF THE INVENTION

An invention is disclosed that overcomes the aforementioned problems, and provides a direct media monitoring/printing system. In one aspect of the invention, a method of determining the position of a label media and printing to the label media based on the label media position is disclosed. The method includes using an encoder to track the position of the label media. As the label media advances during printing, an encoder shaft rotates with an encoder traction roller upon which the label media rides. As the encoder shaft rotates, optical reflections that occur within the encoder are interrupted, each interruption corresponding to a desired media travel distance. When the optical reflection is interrupted, the encoder sends a signal to the controller, which then sends a control signal to fire the printhead, and consequently the label media is thermally printed. The system is useful in thermal printer systems to provide more accurate position information of the label media, and consequently, more accurate printing. In this manner, with the encoder tracking the motion of the media, the timing of the printing of the label media is determined upon the actual position of the label media itself.

Various other features, objects and advantages of the present invention will be made apparent from the following detailed description and the drawings.

BRIEF DESCRIPTION OF THE DRAWINGS

The drawings illustrate one mode presently contemplated for carrying out the invention.

In the drawings:

FIG. 7 is a cross-sectional view taken along line 7—7 of FIG. 6;

FIG. 8*a* is a cross-sectional view taken along line 8*a*—8*a* of FIG. 7 showing the pivoting action of the encoder assembly when printing;

FIG. 8*b* is a cross-sectional view taken along line 8*b*—8*b* of FIG. 7 showing an encoder lift cam when printing;

FIG. 8*c* is a cross-sectional view taken along line 8*c*—8*c* of FIG. 7 showing the printhead registration and encoder assembly when printing;

FIGS. 9*a–c* are cross-sectional views similar to FIGS. 8*a–c* showing various aspects of the encoder assembly when not printing;

FIG. 11*a* is a cross-sectional view taken along line 11*a*—11*a* of the encoder assembly of FIG. 8*c* showing the encoder assembly encoder traction roller and label media when printing;

FIG. 11*b* is a cross-sectional view taken along line 11*b*—11*b* of the encoder assembly of FIG. 9*c* showing the encoder assembly encoder traction roller and label media when not printing;

FIGS. 12*a–d* are perspective views of an exemplary encoder used in the present invention;

DETAILED DESCRIPTION OF THE PREFERRED EMBODIMENT

In the following detailed description, references are made to the accompanying drawings which form a part of this application, and in which is shown by way of illustration specific embodiments in which the invention can be practiced. These embodiments are described in sufficient detail to enable those skilled in the art to practice the invention, and it is to be understood that other embodiments can be utilized and that various changes can be made without departing from the spirit and scope of the present invention. Moreover, in the detailed description, like numerals are employed to designate like parts throughout the same. Various items of equipment, such as fasteners, fittings, etc., in addition to various other elements and specific principles of their operation, are omitted to simplify the description. However, those skilled in the art will realize that such conventional equipment and principles of operation can be employed as desired.

Figure 1:
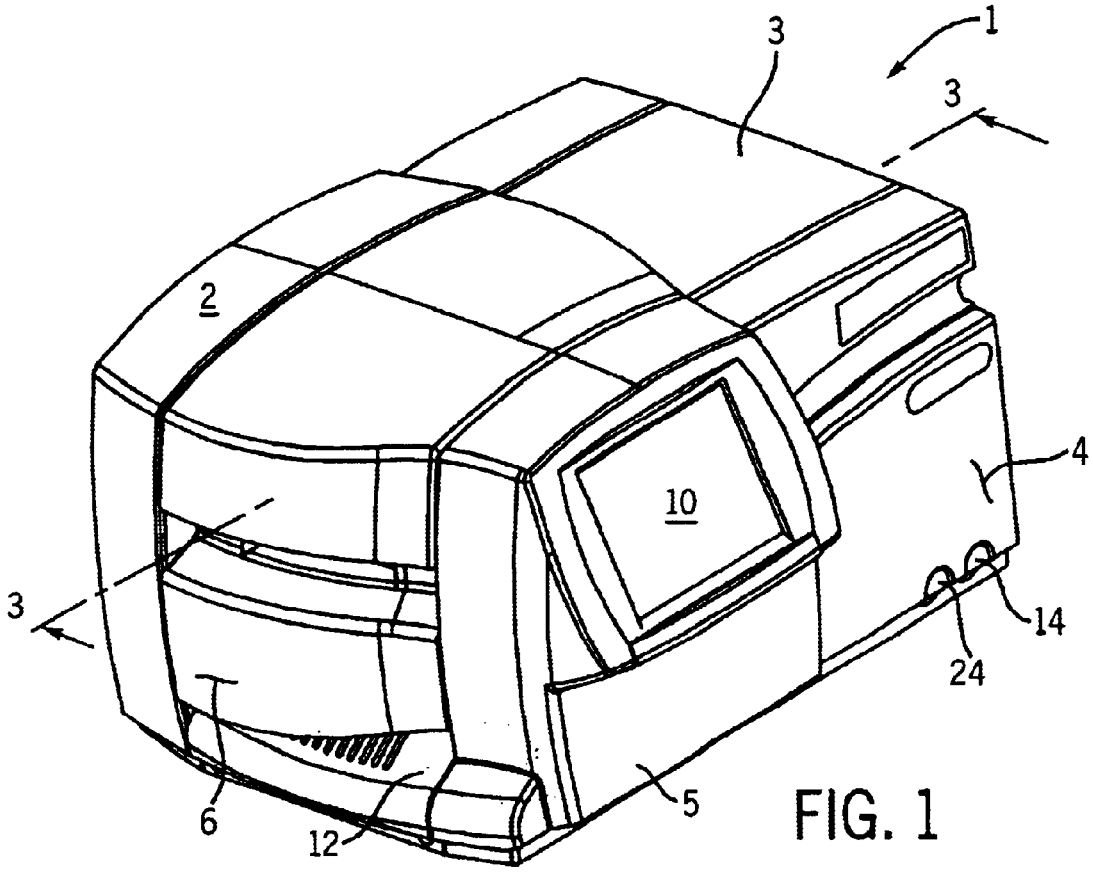
FIG. 1 is a perspective view of a label printer that can employ the encoder control system in accordance with the present invention.

Shown in FIG. 1 is label printer 1. In a preferred embodiment, printer 1 can accomplish both printing and cutting operations in a single unit and thus, label printer 1 can also be referred to herein as a "label printer-cutter." Printer 1 includes a plastic housing 2 having a front 4, a back (not shown), a left side 6 and a right side (not shown). Printer 1 includes cover portion 3 and base portion 5. In FIG. 1, the cover portion is closed, and so printer 1 is shown in a configuration that is suitable for, for example, operation or transport.

Housing 2 supports an LCD screen 10 that can be pivotally mounted to housing front 4. Printed labels (not shown) are ejected from printer 1 via exit chute 12 formed in the housing side 6. LCD screen 10 can display, among other things, printer status and error indicators to a user of the printer. First adjustment mechanism 24 can be included, for example, to control and/or adjust LCD screen 10 brightness. Other parameters, such as print or color intensity of an output label, can also be adjusted, for example, by second adjustment mechanism 14.

Although not shown, it is contemplated that the printer 1 can be connected to, and usable with, a data entry device, such as keyboard, for entering alpha-numeric information necessary for preparation and design of a desired output. Printer 1 can include firmware (e.g., software designed on a platform such as Windows CE™), available from Microsoft and software for controlling, in whole or in part, various printer assemblies, among them the registration assembly, described below.

As used in this application, to "register" means to align, so as to position in alignment, for example, one device, apparatus or assembly with respect to another and "registration" means to function, for example in a method of printing, so as to appropriately register.

Figure 2:
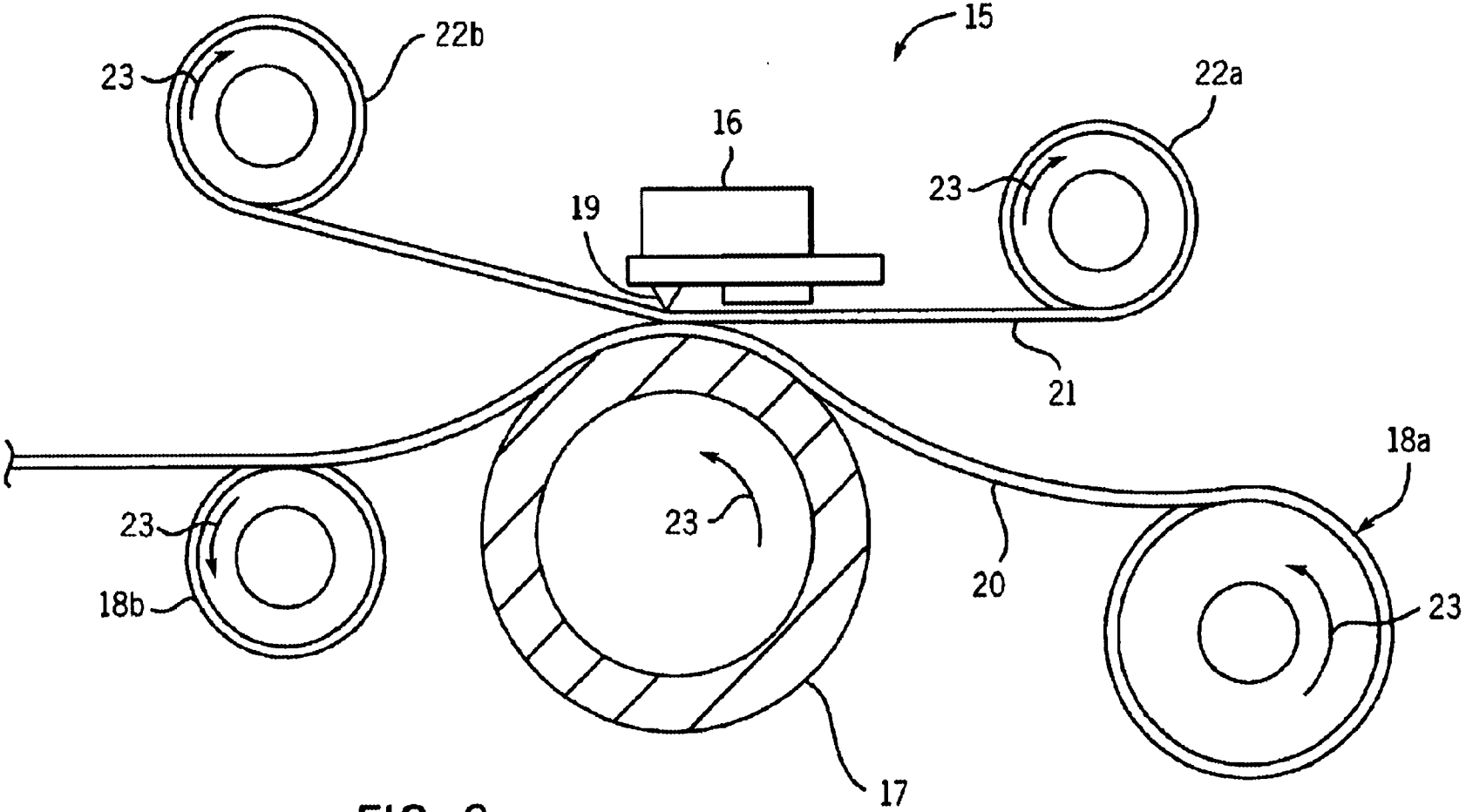
FIG. 2 is a schematic illustration of one embodiment of a printing arrangement that can be used with the label printer of FIG. 1.

A typical thermal printing arrangement 15 is illustrated schematically in FIG. 2 since, in a preferred embodiment, the label printer of FIG. 1 can be a thermal label printer. Printing arrangement 15 includes printhead 16, support (platen) roller 17, label media delivery roller 18*a*, and label media take-up roller 18*b*. Label media delivery and take-up rollers 18*a,b* can be separate components, or alternatively, they can be housed within a unitary structure (e.g., a label media supply cartridge). Printhead 16 is typically equipped with a linear array of thermal elements 19. The number of thermal elements 19 in the linear array can vary, with a characteristic printhead 16 employing one thousand two hundred forty-eight (1,248) thermal elements 19. Thermal elements 19 produce heat in response to energy supplied to printhead 16. A current is applied to thermal elements 19 to heat the thermal elements to a level sufficient to transfer dots onto label media 20. This occurs when a thermally-sensitive (e.g., an ink ribbon) supply 21 comes into thermal contact with thermal elements 19. Printing arrangement 15 includes thermally-sensitive supply delivery roller 22*a* and thermally-sensitive supply take-up roller 22*b*. Thermally-sensitive supply delivery and take-up rollers 22*a,b* can be separate components, or alternatively, they can be housed within a unitary structure (e.g., an ink ribbon cartridge). It is contemplated that color printing can be accomplished as well as black (along with shades of gray). Directional arrows 23 indicate the direction of travel of platen roller 17, label media delivery and take-up rollers 18*a,b* and thermally-sensitive supply delivery and take-up rollers 22*a,b* in printing arrangement 15. Other structures (e.g., a ceramic material layer) may be included in the printing arrangement between the printhead and the label media to be printed. Thermal elements 19 transfer dots to label media 20 in a line, called a "dot line."

As used herein, "firing" or "to fire" a printhead means the process of sending a control signal to the printhead resulting in the controlled heating of the thermal elements.

Figure 3:
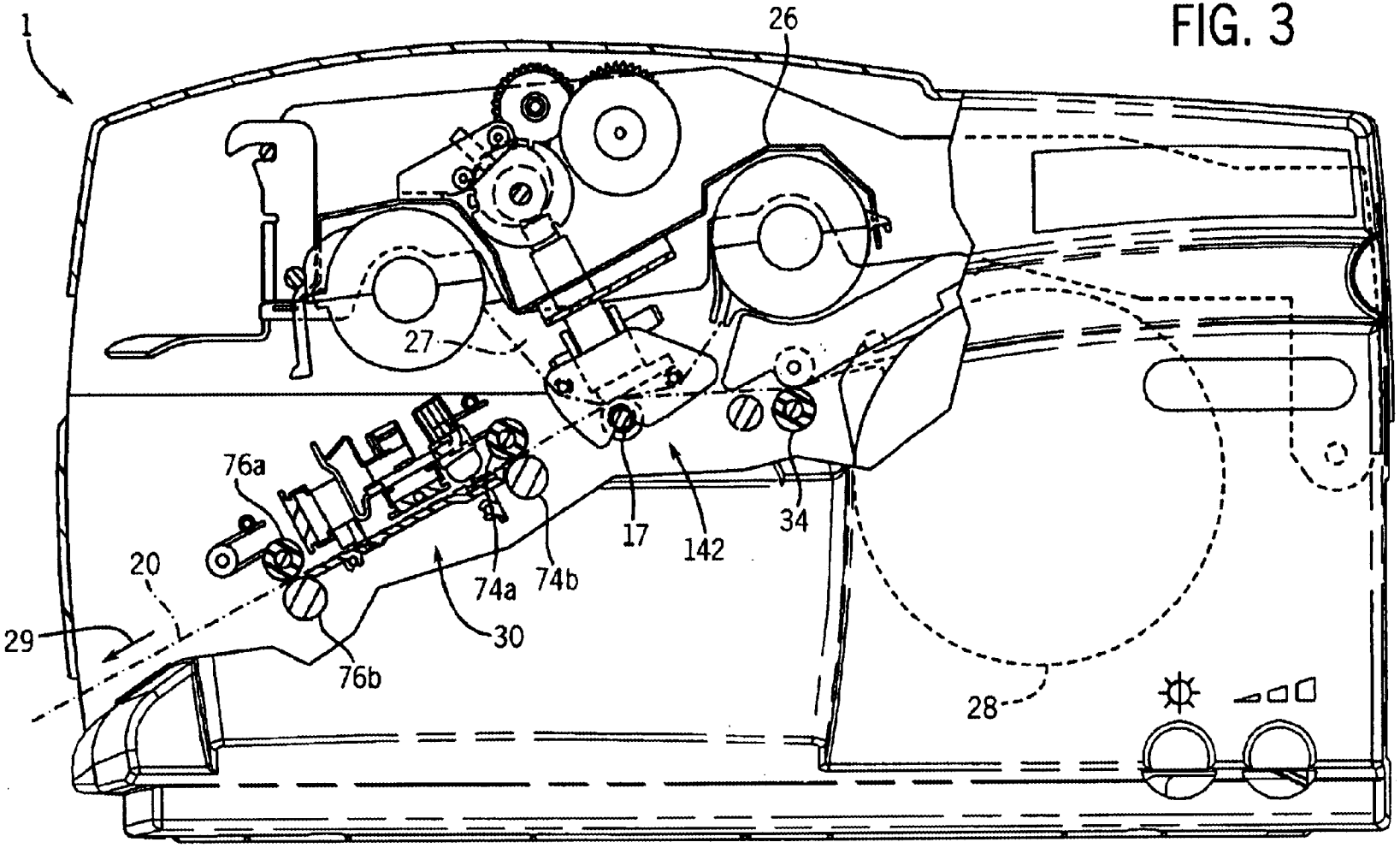
FIG. 3 shows an enlarged, partially schematic, cross-sectional view of the label printer taken along line 3—3 of FIG. 1.

FIG. 3 shows a schematic illustration of label printer-cutter 1. Label media 20 is dispensed from label media supply cartridge 28 (shown in dashed lines) in a label media direction, indicated by arrow 29. Ink ribbon 27 is dispensed from ribbon cartridge 26. As shown, label media 20 and ink ribbon 27 pass in overlay fashion past printhead assembly 142. Once printing has been completed, label media 20 can be fed to cutting assembly 30 (shown in phantom). Printhead assembly 142 is detailed below. Encoder roller shaft 34 is also shown. Encoder roller shaft 34 works in conjunction with an encoder to measure or meter the amount of label media that has passed a given point. Such metering facilitates accurate printing, particularly in multicolor printing applications. Cutter rollers 74*a,b* and 76*a,b* (again shown in phantom) are also shown and are described in greater detail below.

Operation of one cutting assembly capable of use in the label printer is more fully described in co-pending U.S. patent applications entitled "Label Media-Specific Plotter Cutter Depth Control" and "Label Printer End and Plotter Cutting Assembly," both filed concurrently with the present application and both of which are fully incorporated by reference herein.

Referring generally to FIGS. 1–3, label printer assemblies (e.g., label printer printhead assembly 142) and LCD screen 10 are controlled by printer circuitry. Housing 2 of label printer 1 can be manufactured, along with its various assemblies, according to known manufacturing principles (e.g., injection molding) and using known materials (e.g., plastic, metal, and the like). Cover and base printer portions 3 or 5 can be designed to hold programmable memory devices known as flash cards that can be used to store firmware and software routines. Flash cards are typically used during product development to facilitate updates to the firmware and other software. Flash cards can be replaced by permanently programmed memory chips. Using the above described firmware and software and the associated memory devices, printer assemblies such as a printhead assembly 142 can be activated and controlled in an automated fashion. As shown, the flash cards or other memory can be installed at location 27.

Figure 4:
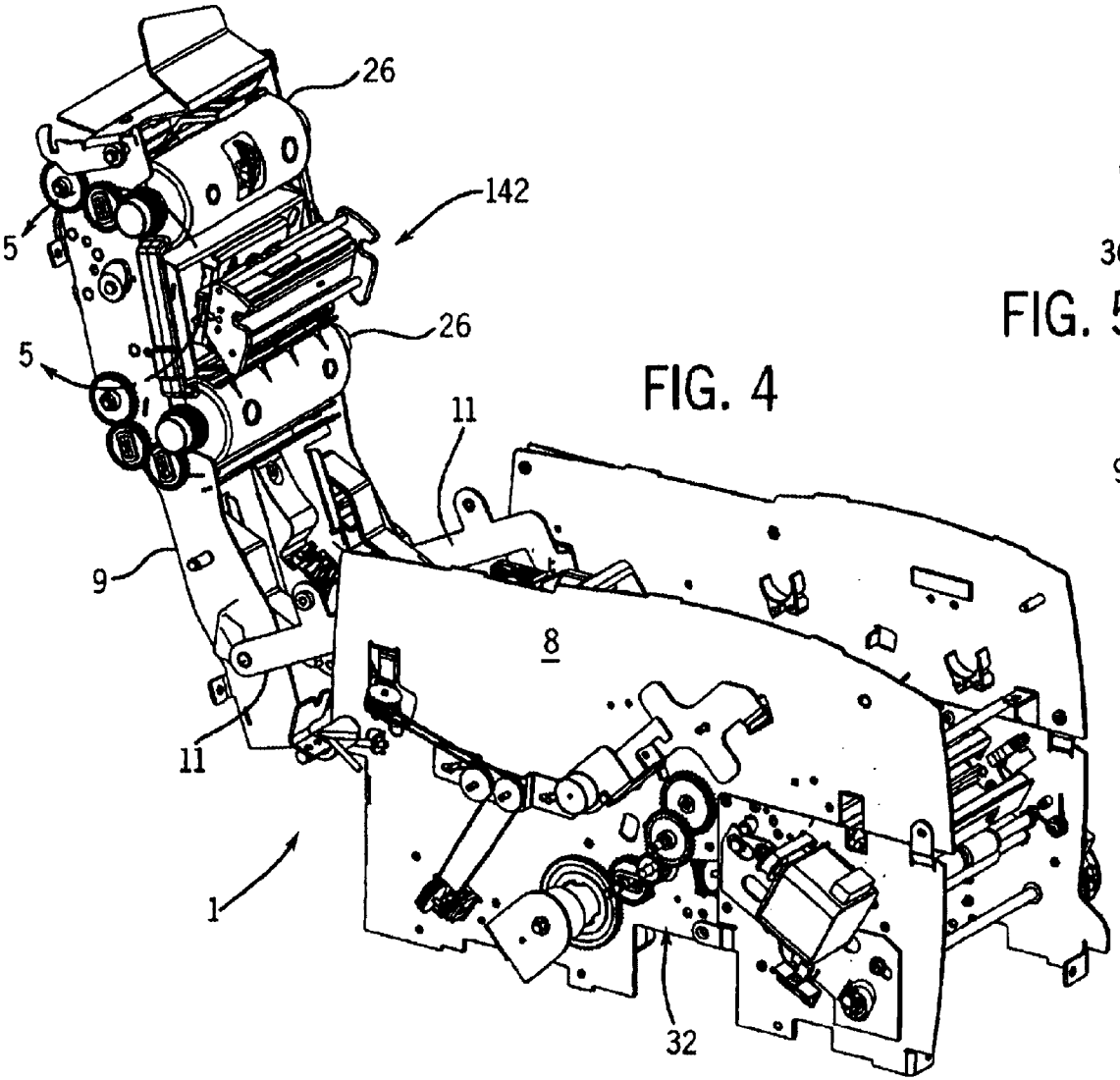
FIG. 4 is perspective view of the label printer of FIG. 1 with the printer in an open position with the cover removed.

Referring now to FIG. 4, is a perspective view of label printer 1 of FIG. 1 with the printer cover portion 3 open and the housing removed so as to expose base portion frame 8 as well as various interior components of the label printer. Cover portion frame 9 is attached to base portion frame 8 using hinged attachments 11. Attached to cover portion frame 9 is printhead assembly, generally referred to by number 142. Ink ribbon cartridge 26 is shown insertably engaged to cover portion frame 9. A number of gear trains, for example gear train 32, are shown and are utilized to effect movement of various of the label printer assemblies.

Figure 5:
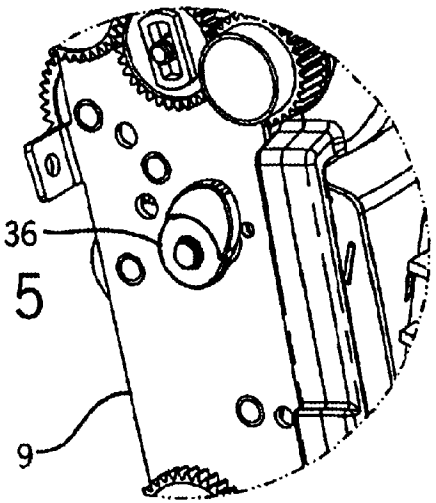
FIG. 5 is an enlarged view taken along line 5—5 of the label printer of FIG. 4.

FIG. 5 is an inset of cover portion frame 9 taken along line 5—5 of FIG. 4. Cam 36 (also referred to as "encoder cam" herein) is shown to be secured, so as to permit rotational movement of the cam, to cover portion frame 9. Cam 36 functions in operable association with encoder assembly 110 (see FIGS. 8*a*–8*b*) and with printhead assembly 142 (see FIGS. 8*c* and 9*c*).

Figure 6:
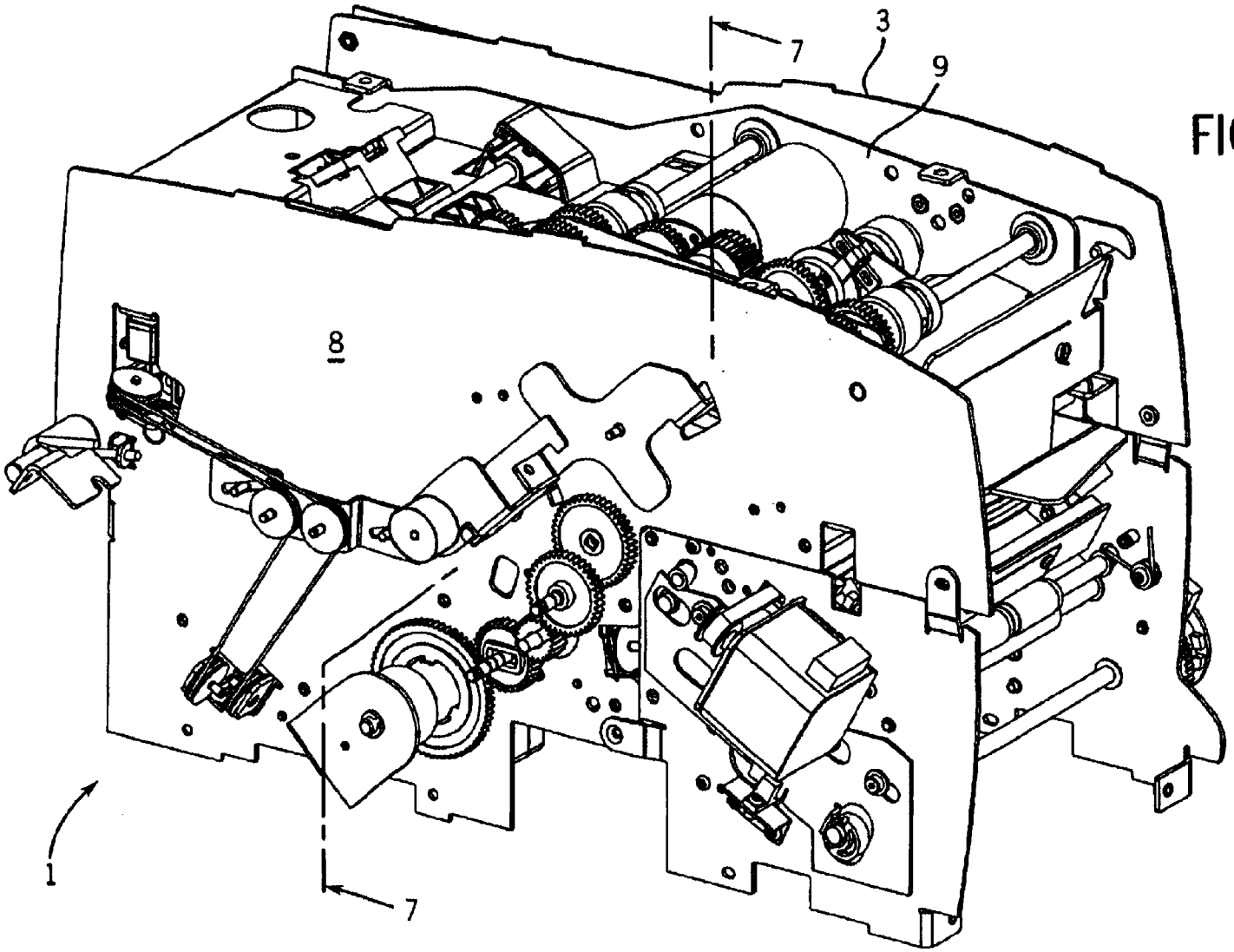
FIG. 6 is a perspective view of the label printer of FIG. 1 with the printer in a closed position with the cover removed.
Figure 12C:
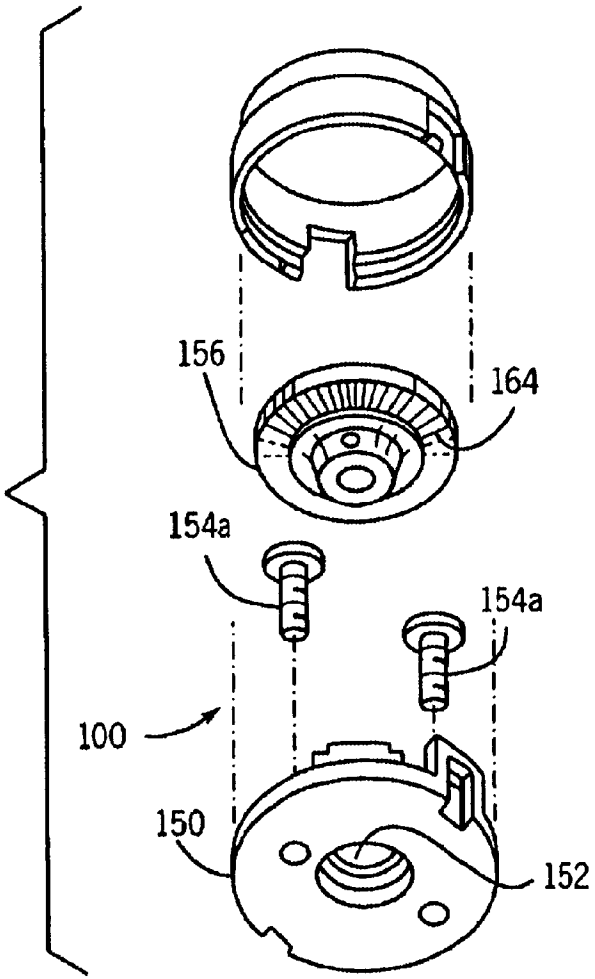
Figure 12D:
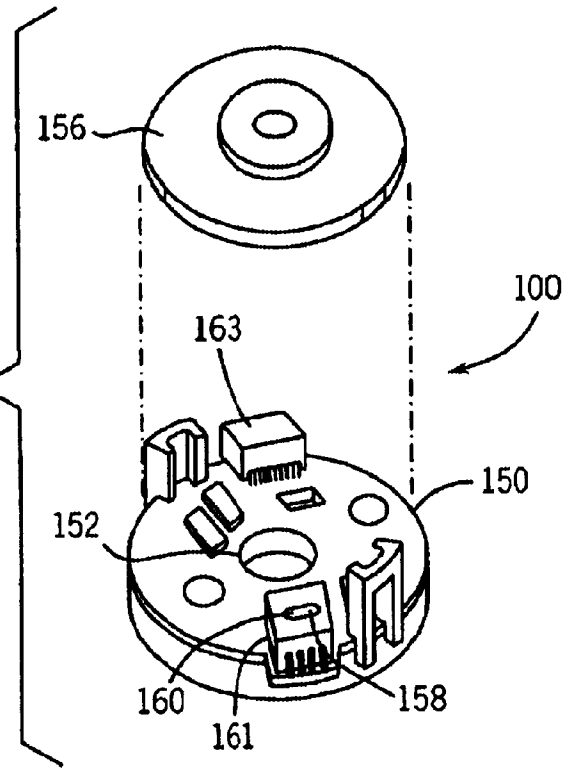

Turning now to FIG. 6, a perspective view is shown of label printer 1 of FIG. 1 with the printer cover portion 3 closed. Frame portion 8 is thus engaged to frame portion 9 so that the printer is ready for printing to a label media. Again, various mechanical linkages, pulleys, gears, and shafts, etc. are shown so as to illustrate complex mechanical interrelationship of the parts within the label printer.

FIG. 7 is a cross-sectional view taken along line 7—7 of FIG. 6 showing encoder assembly 110. Encoder assembly 110 includes encoder shaft 132 which is in rotatable engagement with base portion frame 8. Encoder shaft 132 includes encoder traction roller 130. Alternatively, shaft 132 can include a shaft traction portion. Disposed on one end of shaft 132 is encoder mechanism, detailed below, and generally referred by numeral 100. Also shown in FIG. 7 is encoder cam 112, which engages encoder cam shaft 131, which engages, via cam 78 and so as to be operative with, printhead assembly 142 (FIG. 4). Encoder cam 112 contacts encoder lift bracket 116, which can move encoder pivot bracket 120. Pivot bracket 120 is pivotally connected, as shown via pivot spring 121, to encoder shaft 132. Label media 20 is shown to pass over, so as to be in contact with, encoder traction roller 130.

Referring now to FIG. 8*a*, a pivoting action of the encoder assembly 110 is shown. When printing is desired, encoder cam 112 (shown in phantom) rotates, thereby providing a lifting action as indicated by arrows 114*a* and *b*, for encoder lift bracket 116, which contacts cam 112 through base portion frame 8. Lifting of the encoder lift bracket 116 at one end causes a downward force or motion about pivot 115 indicated by arrow 118 on the other end. Because encoder lift bracket 116 is in abutting engagement to encoder pivot bracket 120, encoder pivot bracket 120 pivots about pivot shaft 122 which causes encoder 100 along with encoder mounting bracket 124 to move up in a direction indicated by arrow 126.

FIG. 8*b* shows the cam 112 rotated on the other side of base portion frame 8 and encoder lift bracket pivot point 115 to effect engagement of the encoder assembly (FIG. 8*a*), namely, to move encoder traction roller 130 (FIG. 7) into contact with label media 20 (FIG. 7). Encoder lift bracket 116 (shown in phantom) turns or pivots about pivot 115 in response to the cam rotation or camming action of cam 112.

Referring now to FIG. 8*c*, because of the lifting of the encoder 100 and encoder bracket 120 (FIG. 8*a*), subsequently the encoder traction roller 130 and encoder shaft 132 are lifted in a direction indicated by arrow 134 such that encoder traction roller 130 positions in tension label media 20 against passive or pinch roller 136. In this manner, movement of label media 20 rotates encoder traction roller 130 as label media 20 travels towards printhead assembly 142 (as in a printing operation) where label media 20 will be printed to by the printhead 144 as it rolls between the printhead and platen roller 17.

Referring now to FIG. 9*a*, pivoting action of the encoder assembly 110 is illustrated when not printing and tracking of label media 20 does not occur. Encoder cam 112 (shown in phantom) again rotates, thereby providing a retracting action as indicated by arrows 140*a* and *b*, for encoder lift bracket 116. Retraction of encoder lift bracket 116 at one end causes an upward force or motion about pivot 115 indicated by arrow 140*c* on the other end. Because encoder lift bracket 116 is in abutting engagement to encoder pivot bracket 120, encoder pivot bracket 120 pivots about pivot shaft 122 which causes encoder 100 along with encoder mounting bracket 124 to move down in a direction indicated by arrow

140*d*. As shown in FIG. 9*a* cam 116 rotates in a direction indicated by 140*a* such that encoder lift bracket 116 pivots about encoder lift bracket pivot shaft 115 such that encoder lift bracket at one end rotates in a direction indicated by 140*b*. In a motion opposite to that with respect to FIGS. 8*a* through 8*c*, the other end of encoder lift bracket 116 pivots up in a direction indicated by arrow 140*c*, thereby raising encoder pivot bracket 120. Through the pivoting action along pivot shaft 122, encoder 100 and encoder mounting bracket 124 are lowered as indicated by arrow 140*d*.

FIG. 9*b* shows cam 112 rotated on the other side of base portion frame 8 and encoder lift bracket pivot point 115 to effect disengagement of the encoder assembly (FIG. 9*a*), namely, to move encoder traction roller 130 (FIG. 7) out of contact with label media 20 (FIG. 7). Encoder lift bracket 116 (shown in phantom) turns or pivots about pivot 115 in response to the cam rotation or camming action of cam 112.

Referring now to FIG. 9*c*, as a result of the disengagement of encoder assembly 110, encoder shaft 132, along with encoder traction roller 130, are retracted as indicated by arrow 140*e* away from pinch roller 136 such that label media 20 is free to be moved, for example, in a direction indicated by arrow 140*f* as would occur when changing colors and/or completion of printing has occurred. At the same time, printhead assembly 142 includes cam 143 which can rotate in order to unload printhead 144 from contacting ribbon/label media overlay. Printhead 144 lifts as indicated by arrow 140*f*.

Figure 10:
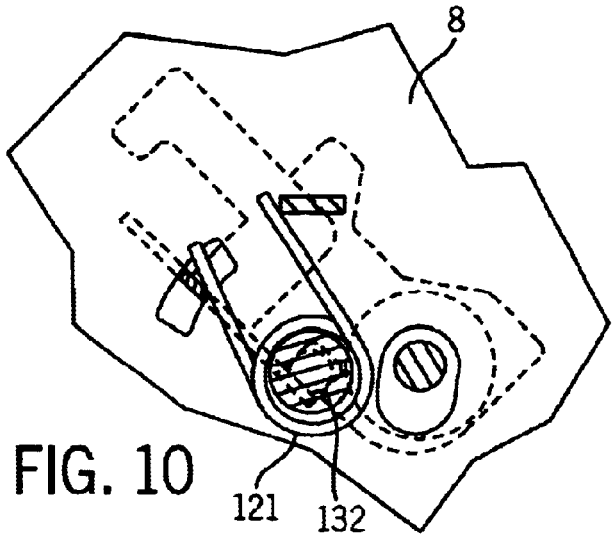
FIG. 10 is a partial cross-sectional view taken along line 10—10 of FIG. 7 showing the encoder shaft pivot spring pivoting action.

FIG. 10 is a partial cross-sectional view taken along line 10—10 of FIG. 7. Pivoting action of encoder shaft pivot spring 121, connected to base portion frame 8, is shown. When the encoder traction roller 130 (FIG. 7) is in contact with the label media 20 (FIG. 7), the encoder shaft pivot spring 121 applies a constant pressure to the encoder traction roller 130 to maintain their positive engagement.

FIG. 11*a* is a cross-sectional view taken along line 11*a*–11*a* of the encoder assembly of FIG. 8*c* showing encoder assembly encoder traction roller 130 and label media 20 when printing to the label media. Encoder 100 monitors the rotation of encoder shaft 132, which is connected to, and rotates along with, encoder traction roller 130. Label media 20 passes between encoder traction roller 130 and pinch roller 136 such that label media movement, as when printing, causes shaft 132 to rotate, and thus permit encoder 100 to monitor the rotation.

FIG. 11*b* is a cross-sectional view taken along line 11*b*–11*b* of the encoder assembly of FIG. 9*c* showing encoder assembly encoder traction roller 130 and label media 20 when not printing. Now, encoder 100 does not monitor rotation of encoder shaft 132, nor advancement of label media 20 since encoder shaft 132, along with encoder traction roller 130, has been retracted away from pinch roller 136.

Referring now to FIGS. 12*a*–*d*, an exemplary encoder 100 as used in the present invention is illustrated. Encoder 100 is made up of an optical module 150 which includes an aperture 152 through which an encoder shaft may be placed and rotated within. Optical module 150 is secured to a mounting surface as by screws 154*a* and *b*. Encoder 100 also includes an encoder disk 156 which is placed onto and rotates with the encoder shaft during rotation of the encoder shaft such that encoder disk 156 rotates at the same rate. Encoder disk 156 includes an optical source 158 and an optical detector 160 (also called an "optical receiver"). The optical source and detector are on a chip such as an HEBR-8100, referred to as numeral 161, which has electrical pinout 162 including power (Vcc), ground, channel A, channel B, as well as an LED voltage line. The power and ground connections, as well as the output channels A and B ("outputs") are connected to electrical connector 163 such that the output of the encoder may be supplied, as to a controller. Optical module 150 may include other components such as resistors and capacitors to provide requisite current-limiting and signal-shaping characteristics. Disk 156 is mounted onto the encoder shaft such that face 164 faces optical encoder source 158. Face 164 includes a pattern of reflective and non-reflective portions which form a radial pattern which is uniformly spaced about the face 164.

During operation, as a label media moves across an encoder traction roller and subsequently rotates the encoder shaft, encoder disk 156 also rotates. Optical source 158 is firing, or emitting an optical light source which is reflected by the reflective portions of pattern face 164 of optical disk 156 and back to optical detector 160. When the disk rotates such that the encoder source light is not reflected back to the optical detector 160, the non-reflection of the optical signal results in an interrupt signal. The interrupt signal is sent to the controller where the controller can then fire a printhead in response thereto. Because the pattern of reflections on disk 156 represents a specified angular displacement of the encoder shaft to which encoder 100 is engaged, each interruption in the reflected optical signal corresponds to a given angular rotation of the encoder shaft, and therefore a linear distance traveled by the label media as it travels over the encoder traction roller and rotates the encoder shaft.

In accordance with a preferred embodiment, the encoder shown is a rotary encoder. This type of encoder is a sensor of mechanical motion that uses light to sense and translate motion, such as, for example, the speed, shaft angle and direction of a rotary shaft, into electrical signals. In a preferred embodiment, an LED, and more preferably a point source LED, or other optical source, is used. The light from the optical source is reflected or bounced back from the disk pattern as collimated light. The number of line pairs in the disk determines the encoder resolution. The light from the optical source that is reflected back is detected using the optical sensor. In a preferred embodiment, the optical sensor is a phased array monolithic sensor. The optical sensor senses the reflected pattern from the encoder disk and converts the reflections, or interruptions of the reflections, into TTL quadrature outputs, which are connected to a controller. A quadrature refers to a 90 electrical degree phase relationship between the A and B channels of the encoder output. A suitable encoder has been the E4 encoder model No. E4-250-125-H available from US Digital Corporation of Vancouver, Wash. The E4 optical kit encoder is a miniature non-contacting rotary to digital position feedback device. This reflective encoder is designed to easily mount to and dismount from an existing shaft. The internal monolithic electronic module converts the real-time shaft angle, speed, and direction into TTL-compatible outputs. The reflective sensor incorporates an LED light source and a monolithic photo detector with signal shaping electronics to produce the two channel bounceless quadrature TTL outputs.

Figure 13:
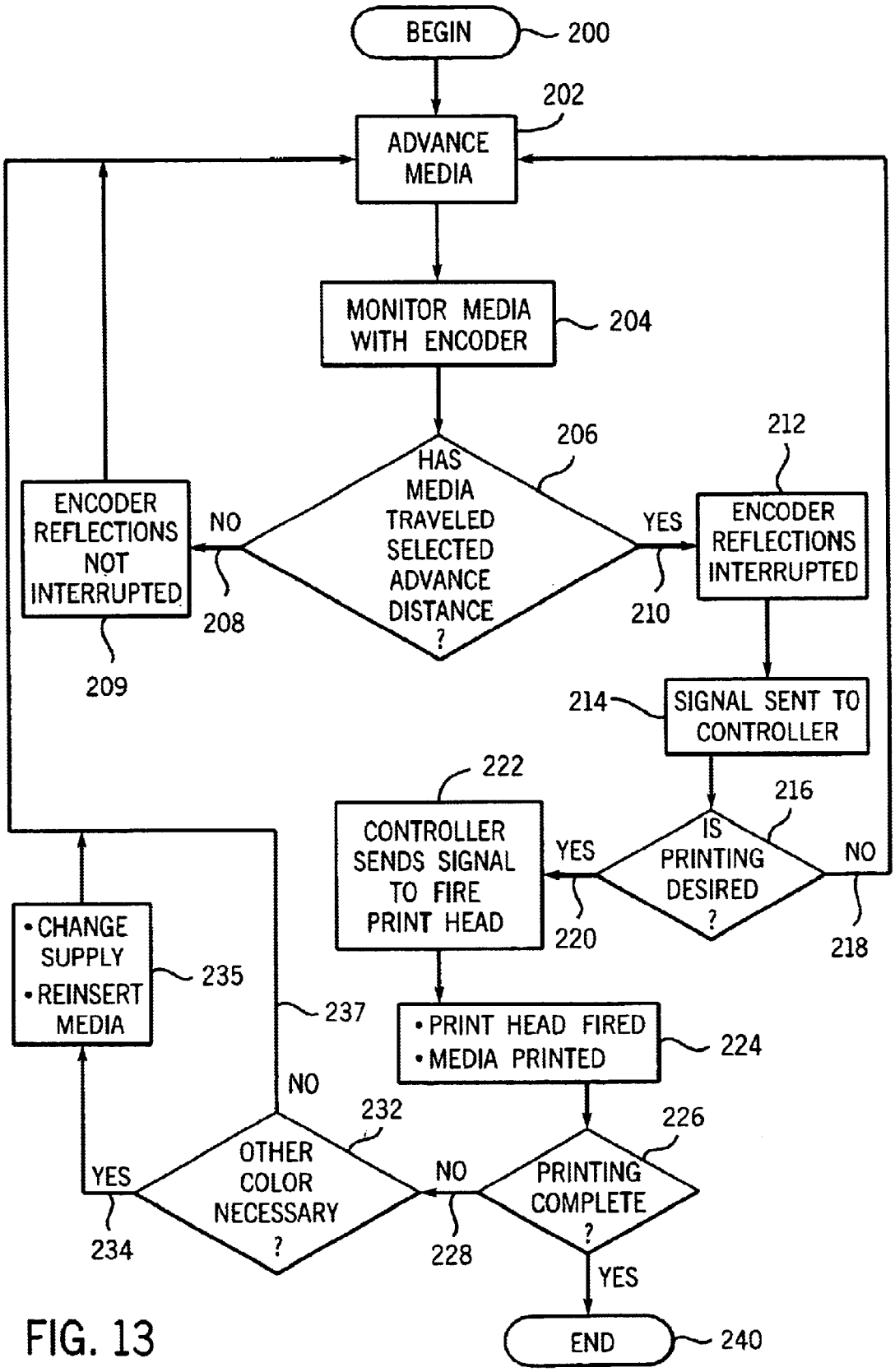
FIG. 13 is a flow chart illustrating one methodology associated with the present invention.

Referring now to FIG. 13, a flow chart illustrating the methodology associated with the present invention is shown. At the beginning 200 of the printing process, the media is advanced 202 with the media traveling over the encoder traction roller and held in place by a pinch roller against the encoder traction roller. The advancement of the media causes a rotation of the encoder traction roller and consequently the encoder shaft. This way the media is monitored 204 and using the encoder it must be determined whether the media has traveled a desired media advance distance 206 (also referred to as "media travel distance"). In a preferred embodiment the media advance distance is 1/300th of an inch, however, any suitable advance distance may be selected as appropriate. If the media has not traveled 208 a distance corresponding to the advance distance as indicated by the encoder reflections not being interrupted 209, the media continues to advance 202, until the same check is made again and the encoder shaft has rotated the appropriate distance. If the media has traveled the desired media advance distance 210, as indicated by interruption of the encoder signal reflections 212, the signal is sent 214 to the controller. The controller then determines whether 216 printing is desired at that particular location on the media. If not 218, the media is then advanced 202. If printing is desired 220, the controller sends a signal 222 to fire the printhead in response to the information received by the encoder about the position of the media. The printhead is then fired 224.

In some cases it will be necessary to determine whether the printing process is complete 226. If not 228, it must then be determined 232 whether another color is desired to be printed on the media. If another color is needed 234, it is necessary to change the ink supply and to re-insert the media 235 that has just been printed into the print system again, where the media can then be advanced 202. If no other color is necessary 237, it is only necessary to advance the media 202 and continue the process. If printing is complete 226, the process is complete 240.

Figure 14:
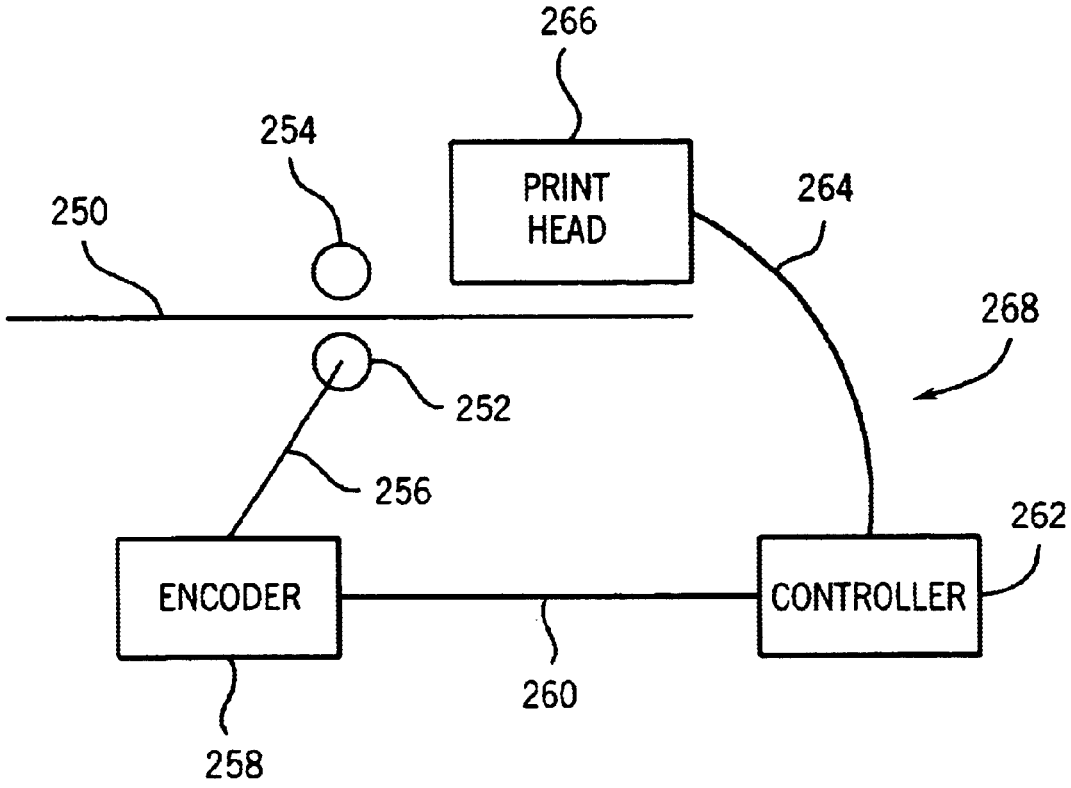
FIG. 14 is a schematic representation of one aspect of the present invention.

Referring now to FIG. 14, a schematic representation of one aspect of the present invention is shown. The purpose of the present invention is to translate label media position and travel distance into control signals that affect the firing on, or printing to, the media itself. In other words, encoder 258 is used as media monitoring device that results in the printing of the label media that it is monitoring. As a label media 250 travels over encoder traction roller 252 during a printing operation, label media 250 is kept in place by pinch roller or other passive roller 254. As label media 250 passes over encoder traction roller 252, it causes encoder traction roller to rotate, along with shaft 256. The rotation of encoder shaft 256 is monitored by encoder 258. Encoder 258 rotates on the same axis as the encoder shaft 256. As the disk within encoder 258 rotates, the amount of rotation corresponds to the amount of rotation of the encoder shaft 256. Therefore, precise advancement of the label media can be captured by the amount of rotation of the media traction roller 252, which is contacting the label media as it moves. This information is communicated at appropriate times via signal 260 to controller 262 or other control mechanism. As a result of the information being received by controller 262 (i.e., that the media has traveled a specific distance) controller 262 can send a signal 264 at appropriate times to printhead 266 to effect firing of the printhead on to media 250 based on the exact media advance of the media 250. It is the positional feedback loop 268 from the media 250 to encoder 258 to microcontroller 262 and ultimately to printhead 266 that accomplishes the result of a print or firing decision being made based upon information obtained from the encoder 258 about the travel distance of media 250.

When the encoder detects the media traveling a specific distance, for example, 1/300th of an inch in one embodiment, the encoder sends a signal to the controller (e.g., a microprocessor) to print the next raster in the print job.

In one embodiment, an encoder-based method of controlling printhead firing in a label printer is disclosed. The method comprises programming a controller to receive an interrupt signal from a rotary-to-digital position feedback encoder. The method further comprises generating a print signal to be sent to the printhead based on the interrupt signal, thereby controlling printhead firing in the label printer.

Methods have been described and outlined in a sequential fashion. Still, elimination, modification, rearrangement, combination, reordering, or the like, of the methods is contemplated and considered within the scope of the appending claims.

In general, while the present invention has been described in terms of preferred embodiments, it is recognized that equivalents, alternatives, and modifications, aside from those expressly stated, are possible and within the scope of the appending claims.

What is claimed is:

1. A media positioning and printing system comprising:

a printhead assembly having a printhead;

a controller for controlling firing of the printhead;

a label media to be printed to by the firing of the printhead; and an encoder system in operational association with the printhead assembly, the encoder system including an encoder shaft having an encoder traction roller securably attached to the encoder shaft, the label media riding along the encoder traction roller, and an encoder attached to the encoder shaft for monitoring the rotation of the encoder shaft and transmitting a signal to the controller, the encoder including an optical source, an optical detector and a reflective optical disk that rotates with the encoder shaft, the reflective optical disk having a reflective pattern, the optical source generating an optical signal, and the reflective optical disk reflecting the optical signal back to the optical detector, the reflective pattern having non-reflective spaces, the optical detector not receiving a reflected optical signal when the optical signal hits the non-reflective spaces of the optical disk, thereby interrupting the optical signal;

wherein, when the encoder shaft rotates, the encoder optical signal is alternately reflected and interrupted so as create a signal interruption, and when the optical signal is interrupted, each resulting signal interruption corresponding to a label media travel distance, the encoder sends a signal to the controller and the controller, based on the signal from the encoder, sends a firing signal to the printhead to fire the printhead in order to effect printing of the label media based on the label media travel distance.

2. The system of claim 1 wherein the label media travel distance is approximately 1/300th of an inch.

3. The system of claim 1 wherein the encoder is a rotary-to-digital encoder.

4. The system of claim 1 wherein the rotation of the encoder shaft corresponds to an angular displacement that is read by the encoder and translated into a digital signal that is sent to the controller.

* * * * *